United States Patent [19]

McIntire

[11] Patent Number: 4,822,006

[45] Date of Patent: Apr. 18, 1989

[54] POLE PULLING APPARATUS AND METHOD

[76] Inventor: Gary L. McIntire, 12 Honeybee La., Idaho Falls, Id. 83402

[21] Appl. No.: 80,346

[22] Filed: Jul. 31, 1987

[51] Int. Cl.[4] ..... B66F 1/02

[52] U.S. Cl. ..... 254/228; 254/31; 294/113

[58] Field of Search ..... 254/228, 30, 31, 29 R, 254/132, 106; 294/113, 114

[56] References Cited

U.S. PATENT DOCUMENTS

| | | | |
|---|---|---|---|
| 953,234 | 3/1910 | Rountree | 294/113 |
| 975,832 | 11/1910 | Clore | 294/114 X |
| 2,484,400 | 10/1949 | Brown | 294/114 X |
| 2,654,630 | 10/1953 | Renfroe | 294/114 |
| 3,163,398 | 12/1964 | Eckels | 254/29 R |
| 3,173,658 | 3/1965 | Verrell et al. | 254/29 R |
| 3,233,868 | 2/1966 | Harvey et al. | 254/31 |
| 3,239,263 | 3/1966 | Farmer et al. | 294/114 X |
| 3,647,185 | 3/1972 | Phibbs | 254/30 |
| 4,082,192 | 4/1978 | Cox | 294/113 X |
| 4,327,534 | 5/1982 | Mastalski et al. | 254/30 X |

FOREIGN PATENT DOCUMENTS

| | | | |
|---|---|---|---|
| 486804 | 5/1918 | France . | |
| 54128 | 3/1983 | Japan | 254/228 |
| 783187 | 11/1980 | U.S.S.R. | 294/113 |

*Primary Examiner*—Joseph J. Hail, III

*Attorney, Agent, or Firm*—Hopkins, French, Crockett, Springer & Hoopes

[57] ABSTRACT

An apparatus for removal of embedded utility-type poles which removes the poles quickly and efficiently from their embedded position without damage to the pole or surrounding structures. The apparatus includes at least 2 piston/cylinder members equally spaced about the pole, and a head member affixed to the top of each piston. Elongation of the piston induces rotation of the head into the pole to increase the gripping action and reduce slippage. Repeated actuation and retraction of the piston and head member will "jack" the pole from its embedded position.

6 Claims, 3 Drawing Sheets

POLE PULLING APPARATUS AND METHOD

The U.S. Government has rights in this invention pursuant to Contract Number DE-AC07-76ID01570 between the U.S. Department of Energy and EG&G Idaho, Inc.

BACKGROUND OF THE INVENTION

The present invention relates to an apparatus, and method for its use, which can easily extract large utility-type poles from an embedded location in the earth.

Nothing is forever. So it is with utility poles, billboard pole supports, and other uses of large wooden poles embedded in the earth. Utility poles, such as those that carry electrical and telephone service lines, frequently need to be removed for any one of a number reasons. For instance, the pole may be so old it has lost structural integrity and needs to be replaced for safety reasons. Also, poles are typically removed when utilities are being placed underground or when the space formerly occupied by the pole is needed for building, roadways, etc. Likewise, when such large wooden poles are used for other purposes, such as in the erection of large billboards, they may need to be removed for the same reasons.

Prior to the present invention, when a pole (as used hereinafter, the term "pole" is intended to mean any large, elongate, usually tapered shaft—on the order of 18 inches in diameter and at least 20 feet in length—which is in embedded in the earth and used as a support structure, either for utility lines, billboards, large-area lighting, etc.) needed to be removed, one of the following methods was typically employed:

a. An auger truck is backed up to the pole to be removed, and the boom is secured to the pole. By making repeated upward jerks with the boom, some poles, if not too tightly impacted, could be removed. However, this method is extremely disadvantageous in that it places severe stress on the most expensive equipment typically owned by utility or sign companies—the auger truck.

b. A pilot hole is drilled with an appropriately sized auger immediately adjacent the pole to be removed, which is then pushed or pulled into the adjacent hole, and thereafter pulled out with the boom on the boom truck. While this method works reasonably well in rural areas, it presents many problems and hazards if attempted in an urban setting, where underground utilities, pavement, etc., can limit its use. Also, after having extracted a pole by this means, it is thereafter difficult to insure that a new pole placed in the original hole will be firmly held in place, as the hole is, in effect, twice as big as was necessary.

c. The third method, and in many instances the one preferred by many individuals pulling large poles, is a pole puller such as that identified by part number H4910, manufactured and sold by Fairmont Hydraulics of Fairmont, Minn. This device comprises an hydraulic cylinder mounted to a base, with the cylinder aligned vertically adjacent the pole to be removed. The cylinder is affixed to the pole at the top and bottom of the cylinder with a chain wrapped around the pole. Repeated actuations of the cylinder permit the pole to be extracted in small increments. The major problems with such apparatus are:

1. the chains slip, thereby making extraction of some poles very difficult;

2. the chains must be unwrapped from the pole prior to each downward (return) stroke of the cylinder, thereby increasing the time required for extraction;

3. the device cannot be used on a pole having conduits from the pole into the ground which are to remain, since the pressure of the chains wrapped around the pole might crush or pull out the conduits;

4. it is difficult to obtain sufficient pulling power with a single cylinder aligned parallel with the pole; and 5. the base is so small that in many cases the base is forced into the ground rather than the pole being extracted.

Faced with these difficulties, many companies have chosen to cut off the pole and leave a "stump" in place, finding it to be less expensive to purchase a new pole rather than attempting to extract the old pole and reuse it. This is obviously a wasteful practice and not a preferred method if a reasonably practicable alternative is available.

It is therefore an object of this invention to overcome the aforementioned difficulties, and provide a pole-pulling apparatus which is easy to operate by a single person, is capable of extracting all conventional poles, and is relatively simple in construction.

SUMMARY OF THE INVENTION

Generally speaking, the present invention comprises an apparatus for extracting poles from a fixed, embedded upright position, such as utility poles, light poles, support poles for billboards, etc. The apparatus includes a base member which straddles the pole, at least 2 elongate piston members, each contained in a cylinder, and an adjustable head member affixed to the top of each piston. The head is provided with gripping means which provide frictional engagement between the head and the pole. Actuating means are provided to actuate the piston.

More specifically, the base member may be provided in a "U" shaped configuration, with at least 1 cylinder/-piston member affixed to each arm of the base. Preferably, the pistons are spaced equally about the pole; and most preferably, a pair of cylinder-piston members are located on opposing sides of the pole. The head member is affixed to the pistons such that as the piston is actuated along its longitudinal axis, the head member is caused to rotate, as by a cam action, thereby forcing the gripping means into tighter engagement with the pole. Retaining means are provided such that the head members can be secured to the pole, thereby avoiding slippage as the piston is elongated.

By repeated actuation and retraction of the piston member, a pole may be "jacked" out of the ground, without causing damage to the pole or surrounding structures.

DETAILED DESCRIPTION OF THE INVENTION

Figure 1:
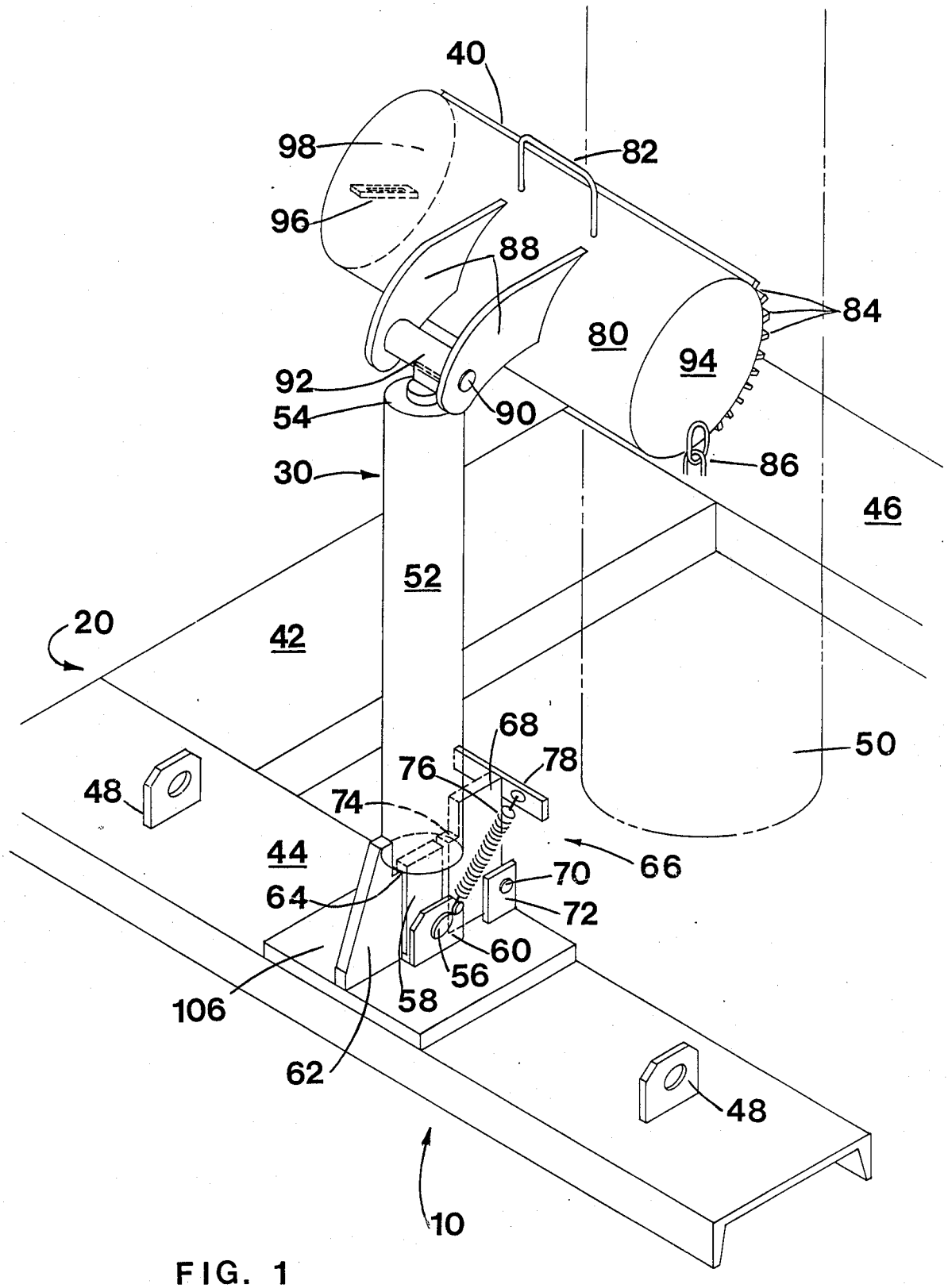
FIG. 1 is an isometric view of ½ of the present invention.

As shown in FIG. 1, the apparatus of the present invention, generally designated 10, comprises a base member 10, an hydraulic cylinder 30, and a head member 40. More specifically, the base member 20 is provided in a "U"-shaped configuration having a cross-member 42 and arms 44, 46. While the base member can be constructed of any suitable materials, applicant has found that steel plates approximately ½ inch in thickness, shaped in a channel (shown in FIG. 1) or box configuration, are acceptable. While the device is illustrated in the drawings in a "U"-shaped configuration, the device is equally susceptible to any other configuration in which two cylinder-bearing arms are rigidly connected. For instance, a "V"-shaped configuration, or a box-configuration (having one removable and replaceable cross-member) are acceptable. In any event, there obviously needs to be an open area between the cylinder-bearing arms 44, 46 in which the pole is centered.

It is to be understood that, for convenience, only one of the hydraulic cylinders 30 and head members 40 have been illustrated on arm 44 in FIG. 1; in actual practice, arm 46 would be provided with an identical structure illustrated on arm 44.

Because the device 10 will be used in conjunction with an auger or boom truck, and because the device is too heavy for an individual to manually place in position for actuation, lifting means 48 are provided at appropriate locations on the base member 20, Again, for ease of illustration, only those lifting means 48 on arm 44 have been illustrated in FIG. 1. A cable mechanism can be affixed to the lifting means 48 and thence to the boom arm of the boom truck to easily lift the device onto and off of the boom truck. The apparatus 10 is placed in a "straddling" relationship to the pole 50 to be removed (shown in broken lines in FIG. 1), with one of the arms 44, 46 on either side of the pole 50.

The hydraulic cylinder 30 comprises an outer cylinder member 52 and an inner piston 54. Appropriate hydraulic connectors and fluid-conveying lines, well known to those skilled in the art, are necessary but not shown in FIG. 1. The cylinder 52 is pivotally connected to the arm 44, as by pin 56. A member 58 is welded to the bottom of cylinder 52 and is retained between a pair of ears 60 by pin 56. Stop member 62 is provided such that when the cylinder is in an upright or vertical position, the lower edge of the cylinder 52 abuts lip 64. In order to maintain the hydraulic cylinder 30 and head member 40 in an upright position for transport, retaining means 66 is provided. Retaining means 66 includes stop member 68 which pivots about pin 70 between a pair of ears 72; Stop member 68 is provided with lip 74 which, as with lip 64, abuts the lower surface of cylinder member 52.

As can be seen in FIG. 1, stop members 62, 68 effectively maintain the cylinder member in a vertical orientation. Retaining means 66 is maintained in the position shown in FIG. 1 by means of tension spring 76 connected at one end to the ear 60 or pin 56, and at the other end to a release means 78.

In order to move the head member 40 into gripping relationship with the pole 50, an operator simply must depress the release means 78 inwardly (toward the pole), thereby releasing hydraulic cylinder 30 and head member 40 from its upright locked position.

The head member 40 is illustrated in the drawings as a cylindrical member, but it is to be appreciated that shape of the member 40 is not critical. As illustrated, the head member 40 comprises a tubular portion 80, handle means 82, a plurality of gripping means 84, retaining means 86 and flanges 88. The head member 40 is affixed to, and rotates about a horizontal axis defined by, pin 90. Sleeve 92 is affixed to the upper surface of piston 54 and retains pin 90 therethrough. Retaining means 86 are affixed to one end 94 of tubular portion 80, while means 96 (shown in broken lines in FIG. 1) to accept and retain retaining means 86 are located on the opposite end 98 of tubular portion 80.

Figure 2:
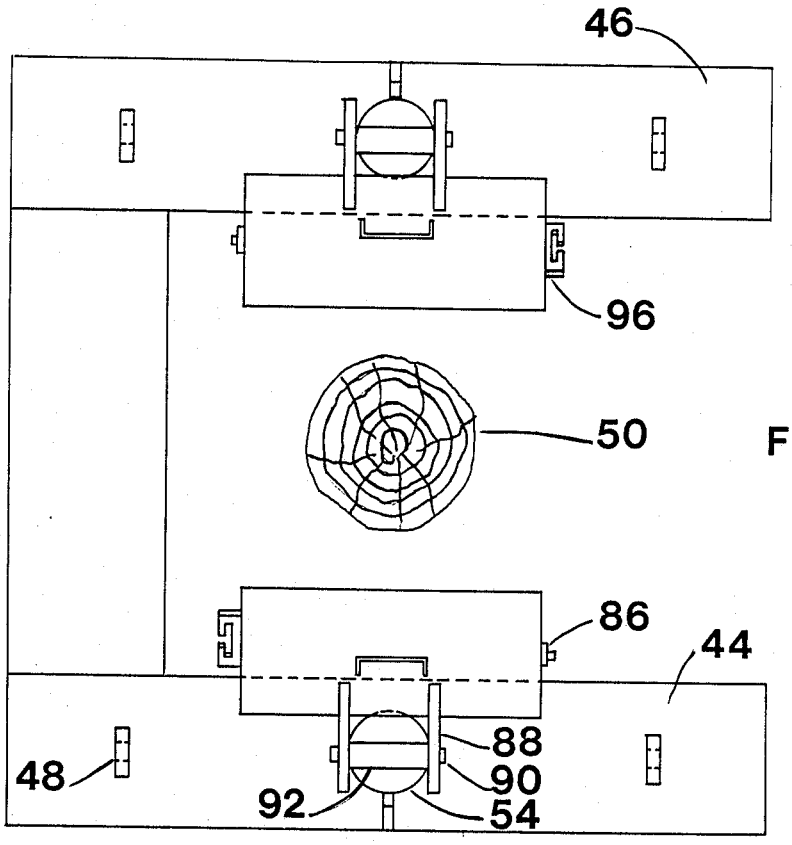
FIG. 2 is a plan view of the apparatus of the present invention.
Figure 3:
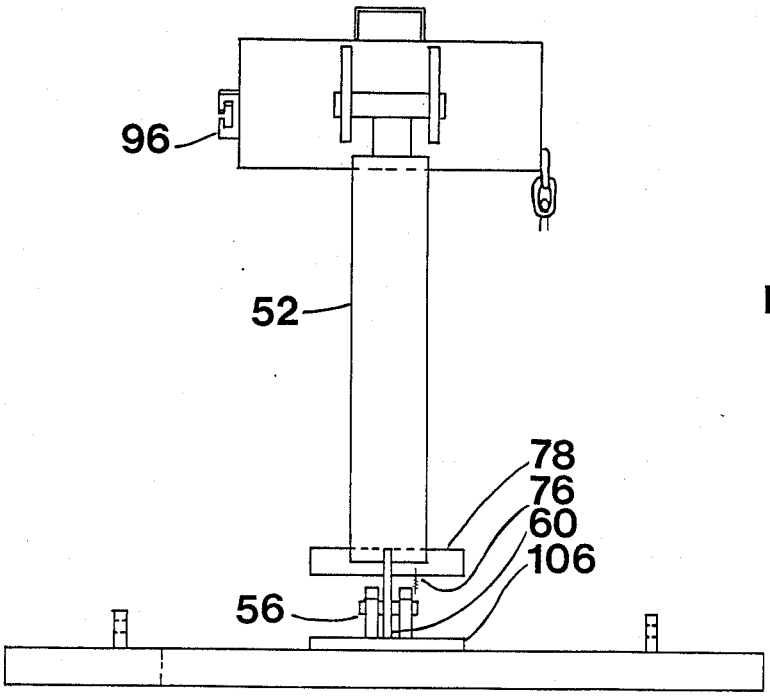
FIG. 3 is a side view of the apparatus of the present invention.
Figure 4:
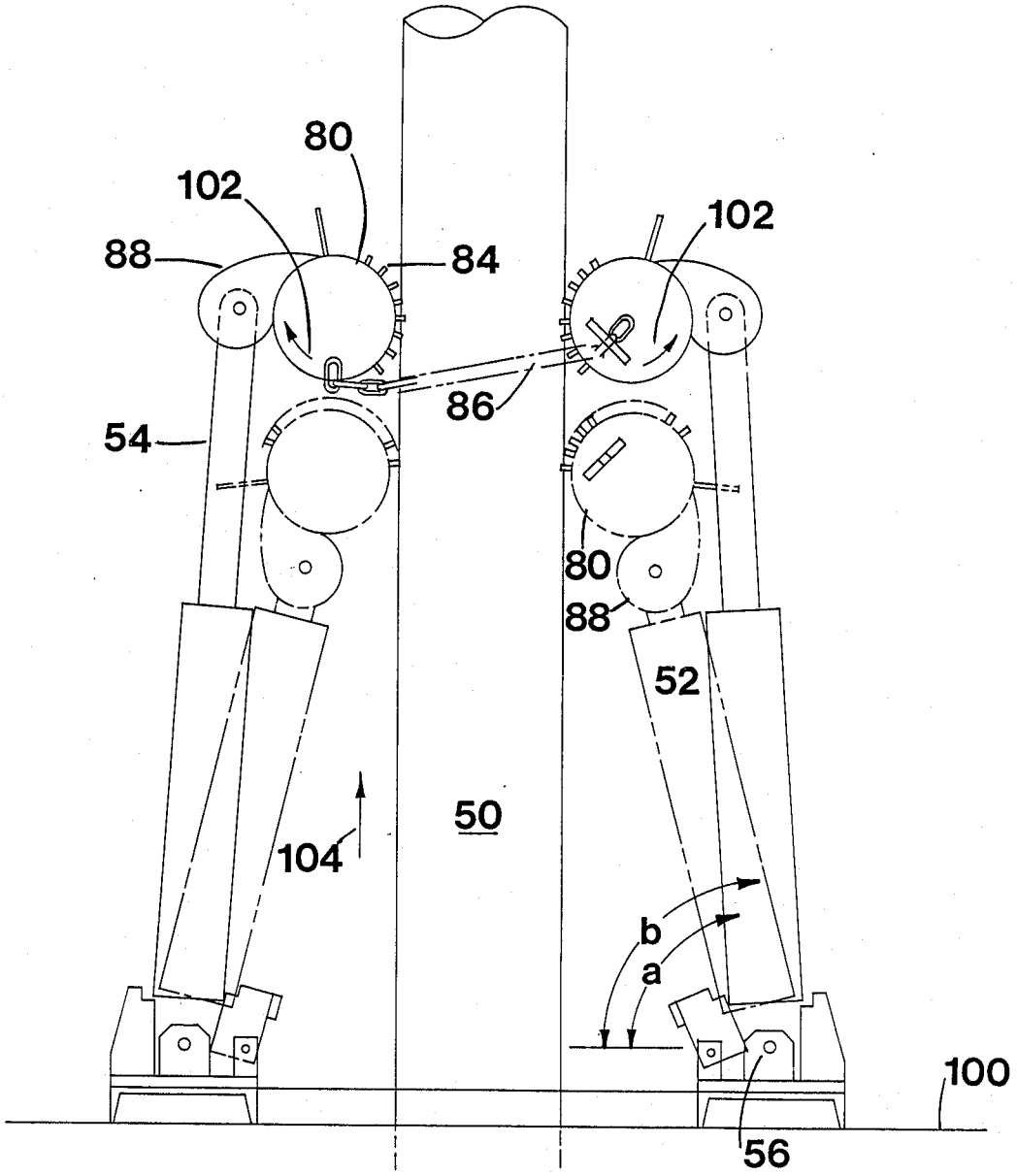
FIG. 4 is a front view of the apparatus of the present invention indicating its method of operation.

FIG. 2 is a plan view of the invention showing arms 44, 46 straddling the pole 50. As shown in FIG. 2, the hydraulic cylinder 30 is in the upright, locked position for storage and/or transport. After being placed in the position shown in FIG. 2, the release means 78 is depressed and the head 40 is placed against the pole 50, with gripping means 84 in contact with the pole. While it is not necessary that the pole be centered exactly midway between arms 44, 46, in order to equalize the action of hydraulic cylinders 30, aligning the pole 50 as near to the center as is practicable insures optimum operation of the apparatus. When the release means 78 are depressed and the head members 40 are rotated about pin 56 so that they lie against the pole 50, the angle defined by hydraulic cylinder 30 and the ground surface 100 is a first acute angle "a", as shown in FIG. 4. As illustrated in FIG. 4, A pair of head members are placed against the pole 50 and the retaining means 86 are secured therebetween so as to maintain the gripping means 84 in contact with the pole. The device is shown in dashed lines prior to actuation of the hydraulic cylinders. Upon actuation of the hydraulic cylinder (shown in solid lines in FIG. 4) the tubular portion 80 of head member 40 is forced to rotate in the direction of arrow 102. Applicant has found that such rotation is a critical feature of his invention.

Tubular portions 80 are not connected to piston 54 in a straight-line configuration. Rather, flange 88 are "goose-necked" so that as the piston 54 is extended from cylinder member 52 the longitudinal axis of piston 54 and cylinder member 52 does not pass through the center of tubular portion 80. Therefore, extension of piston 54 creates not only an upward force on the pole 50 but also a lateral force which direct the gripping means 84 into the pole 50, insuring that the head member 40 does not slip. As illustrated, the head members are secured in position on opposing sides of the pole by retaining means 86, which is welded to one head member and releasable affixed to the other.

It has been found advantageous to supply both hydraulic cylinders 30 from the same pump, as through a "Y" connector, so as to equalize the pressure therebetween. In this manner, the pole is removed vertically rather than at an angle, making extraction easier and reducing the chance of damage to the pole. In operation, when the hydraulic system is actuated, both pistons begin extending simultaneously and with uniform pressure. As the pistons continue extending, the cylinder member 52 rotates about an axis defined by pin 56 so that inclusive angle "a" increases. Concurrently, head members rotate in the direction of arrow 102, and the gripping means 84 "bite" into the pole. Rotation of the head members insures that the retaining means 86 will remain taut, so that further extension of pistons 54 will "pull" the pole upwardly in direction of arrow 104. The inclusive angle between the cylinder member 52 and the ground surface 100 increases to an angle shown as "b".

In operation, the hydraulically-actuated cylinder members 52 are actuated for the maximum stroke of piston 54, thereby raising the pole in direction of arrow 104. When the pistons and head members reverse direction, the head members 40 are permitted to rotate in an direction opposite that shown in arrow 12, so that the gripping means 84 "release" from the pole and the head slides down the pole, to the position shown in dashed lines in FIG. 4. It will be appreciated that removal of the retaining means 86 is not necessary in the operation of this device. Rather, the operator need reverse the directional flow of hydraulic fluid in the hydraulic system (assuming a directional closed loop system is used) in order to retract the pistons and heads to the position illustrated by angle "a" in FIG. 4.

While not wishing to be held to any specific disclosure, it is believed that angle "a" should be from about 45° to about 85°, and preferably from about 60° to about 80°, Angle "b" can be any angle less than 90°, and in most cases (depending upon the distance between arms 44, 46) will be between 70° and 89°.

Typical poles used, for instance, by utility companies for suspending electrical or telephone wires, are provided in lengths of from 45–110 feet, weighing from about 440 pounds to 7600 pounds. These poles are usually sunk at least 6–10 feet below the ground surface, and may be tamped in either with dirt removed from the hole, or may be set in concrete. For a typical 55 foot wood utility pole, the base diameter is approximately 18–20 inches. Therefore, a hole at least that size (and somewhat bigger if the pole is to be set in concrete) must be provided. Applicant has found that base member 20 may advantageously be manufactured from one-half inch thick channel iron with a reinforcing plate 106 beneath each cylinder member 52. Any hydraulic cylinder may be utilized in the construction of the present invention. Applicant has found that for all but the largest and heaviest of utility poles, a six inch diameter hydraulic cylinder rated at greater than 1,000 psi (25 tons of lifting power), and having a two foot piston stroke, will suffice. When utilizing a cylinder having a stroke rated at 2 feet, applicant has found that is it possible to obtain approximately 18 inches of vertical lift on an embedded pole, so that aproximately 4 to 5 cycles are necessary to remove a pole embedded about 6 feet deep.

The head members 40 may be provided having dimensions of approximately 16 inches in length and 10 inches in diameter. Approximately 6–8 gripping means may be provided along the length of the tubular portion 80, each of the gripping means being raised above the surface of the tubular portion from about ½ inch–¾ inch. It has been found that a significant portion of the surface area of tubular member 80 must be covered with gripping means 84 so that as the head member rotates during actuation of the cylinder member, gripping means are available to contact the pole. As will be seen in FIG. 1, when a head is in the "down" position (the position at rest, or when transported as opposed to the "up" position illustrated in dash lines in FIG. 4), the retaining means 86, provided in the form of a heavy chain, depends from the lowermost portion of the head member. Providing the retaining means at the "bottom" of the head member insures that the head member will remain pulled into contact with the pole during piston extension, thereby preventing the head member from slipping or rotating to the "up" position.

The present invention is advantageously used in conjunction with an auger or boom truck for a number of reasons: the boom may be used to raise and lower the device to its operative position; the boom may be used to hold the pole during extraction, and thereafter lower the pole onto the ground or onto a transport device removal; and the hydraulic system provided on such vehicles may be utilized to operate the cylinder members of the present invention. While the invention has been described herein as utilizing hydraulically-actuated cylinder members, it is to be appreciated that any number of other means could be substituted. For instance, motor-driven rotary shafts translating rotary motion into linear motion and ratchet-driven jacks (such as bumper jacks used with trucks and automobiles) may be substituted. Because of the simplicity of operation and the great pressures that can be generated by hydraulics, hydraulics is the preferred method of actuation.

While I have shown and described one desirable embodiment of the invention, it is to be understood that this disclosure is for the purpose of illustration and that various changes and modifications may be made without departing from the spirit and scope of the invention as set forth in the appended claims.

I claim:

1. Apparatus for extracting poles from a fixed, embedded upright position, comprising:

a. a base member adapted to straddle the pole;

b. at least two elongate piston members rotatably affixed to the base member and spaced equally about said pole to permit rotation from a first upright position to a second engaged position against said pole, the piston being displaceable along a longitudinal axis;

c. an adjustable, cylindrical head member affixed to each of said piston members at a pivot point, and having a longitudinal axis through the cylindrical head member aligned perpendicular to the longitudinal axis of the piston member;

d. said cylindrical head member provided with a plurality of gripping means aligned about the longitudinal axis of the head member across a surface of the cylindrical head member;

e. a flange member positioned between the cylindrical head member and the pivot point to provide eccentric rotation of said head member about the pivot point;

f. actuating means to actuate the piston members; and g. stop members mounted to the base member for releasably locking the elongate piston members in their first upright position.

2. The apparatus as set forth in claim 1, wherein each head member is provided with retaining means interconnecting the head members and positioned such that the retaining means cause the distance between the cylindrical surface of the head members to decrease upon actuation of the piston members.

3. The apparatus as set forth in claim 1, wherein the base member is a U-shaped member.

4. Apparatus for extracting poles from a fixed, embedded upright position, comprising:

a. a base member adapted to straddle the pole;

b. at least two elongate piston members rotatably affixed to the base member and spaced equally about said pole to permit rotation from a first upright position to a second engaged position against said pole, the pistons being actuated along a longitudinal axis;

c. an adjustable, cylindrical head member affixed to each of said piston members at a pivot point, and having a longitudinal axis through the cylindrical head member aligned perpendicular to the longitudinal axis of the piston member;

d. said cylindrical head member having a circumferential surface and provided with a plurality of gripping means aligned about the longudinal axis across the circumferential surface of the head member;

e. a flange member positioned between the cylindrical head member and the pivot point to provide eccentric rotation of said head member about the pivot point;

f. the circumferential surface of the head members defining a radius of curvature which is smaller than the radius of curvature defined by an arc of the head member pivoting about the pivot point;

g. actuating means to actuate the piston member; and h. stop members mounted to the base member for releasably locking the elongate piston members in their first upright position.

5. Apparatus for extracting poles from a fixed, embedded upright position, said pole having a subterranean portion and an above-ground portion, the apparatus comprising:

a. a base member adapted to straddle the pole;

b. at least two elongate piston members affixed to the base member and spaced equally about said pole to permit rotation from a first upright position to a second engaged position against said pole, the pistons being displaceable along a longitudinal axis a distance substantially less than the length of the subterranean portion;

c. an adjustable, cylindrical head member affixed to each of said piston members at a pivot point, and having a longitudinal axis through the cylindrical head member aligned perpendicular to the longitudinal axis of the piston member;

d. said cylindrical head member provided with a plurality of gripping means aligned about the longitudinal axis of the head member across a surface of the cylindrical head member;

e. a flange member positioned between the cylindrical head member and the pivot point to provide eccentric rotation of said head member about the pivot point;

f. actuating means to actuate the piston members; and g. stop members mounted to the base member for releasably locking the elongate piston members in their first upright position.

6. The apparatus as set forth in claim 5, wherein the circumferential surface of the head members define a radius of curvature which is smaller than the radius of curvature defined by an arc of the head member pivoting about the pivot point.

* * * * *